US006358189B1

(12) United States Patent
Koenig

(10) Patent No.: US 6,358,189 B1
(45) Date of Patent: Mar. 19, 2002

(54) EXERCISE APPARATUS FOR UPPER EXTREMITIES

(75) Inventor: Larry D. Koenig, Williamsburg, IA (US)

(73) Assignee: Jam'n Fitness Corp., Altus, OK (US)

( * ) Notice: Subject to any disclaimer, the term of this patent is extended or adjusted under 35 U.S.C. 154(b) by 0 days.

(21) Appl. No.: 09/538,714

(22) Filed: Mar. 30, 2000

(51) Int. Cl.[7] ..... A63B 21/08
(52) U.S. Cl. ..... 482/97; 482/136; 482/137
(58) Field of Search ..... 482/93, 94, 97, 482/98, 100, 104, 133, 139, 135–137, 140

(56) References Cited

U.S. PATENT DOCUMENTS

| | | | | | |
|---|---|---|---|---|---|
| 4,621,810 | A | * | 11/1986 | Cummins | 482/97 |
| 4,949,951 | A | * | 8/1990 | Deola | 482/100 |
| 4,974,835 | A | * | 12/1990 | Klink | 482/97 |
| 5,184,991 | A | * | 2/1993 | Brangi | 482/97 |
| 5,304,108 | A | * | 4/1994 | Denega et al. | 482/97 |
| 5,702,329 | A | * | 12/1997 | Koenig | 482/97 |
| 5,769,757 | A | * | 6/1998 | Fulks | 482/97 |
| 5,810,701 | A | * | 9/1998 | Ellis et al. | 482/136 |
| 5,813,951 | A | * | 9/1998 | Einsig | 482/97 |
| 5,957,817 | A | * | 9/1999 | Koenig et al. | 482/72 |
| 6,004,247 | A | * | 12/1999 | Webber | 482/100 |
| 6,015,370 | A | * | 1/2000 | Pandozy | 482/97 |
| 6,179,757 | B1 | * | 1/2001 | Kenig | 482/97 |

OTHER PUBLICATIONS

Powerline by Tuffstuff, PL–314 Incline Lever Row, Task Industries, Inc.*

Hammer Strength Rowing/Seated Shrug, Hammer: First in Strength, Hammer Strength brochure, p. 11, circa 1994.

Advertising brochure "Hammer Strength", undated, Hammer Strength, P.O. Box 19040, Cincinnati, OH 45219.

Advertising brochure "Hammer Strength Product Information Guide Feb., 1997", Hammer Strength, P.O. box 19040, Cincinnati, OH 45219.

Advertising brochure "Hammer Strength Ground Base Technology", undated, Hammer Strength, P.O. Box 19040, Cincinnati, OH 45219.

* cited by examiner

*Primary Examiner*—Mickey Yu
*Assistant Examiner*—Victor Hwang
(74) *Attorney, Agent, or Firm*—Allan L. Harms

(57) ABSTRACT

Exercise apparatus for strengthening the triceps, deltoid and pectoral muscles. A moveable yoke is dual hinged to an upright support mounted to a base. The yoke has a pair of spaced apart levers each perpendicularly fixed to a weight moment arm. Free weights may be attached to the weight moment arms. The yoke may be rotated about a vertical axis over a limited non-symmetrical range from a park position to an operating position. The yoke is also pivotable about a horizontal axis in the operating position. A seat and back rest are supported on the base spaced apart from the upright support.

20 Claims, 5 Drawing Sheets

EXERCISE APPARATUS FOR UPPER EXTREMITIES

BACKGROUND OF THE INVENTION

The present invention pertains to exercise apparatus for increasing upper extremity strength. The repetitive exercise of the arms and shoulders against a resistance strengthens the chest, triceps and shoulder musculature. In many existing upper arm strengthening apparatus, cables and pulleys are used to allow the arms of the user to raise and lower weights. In other apparatus, elastic ropes or bands or other spring structures are used to provide resistance to movement of the arms. Various apparatus also replicate the action of rowing to strengthen arm muscles. However such apparatus exercise the biceps rather than the triceps of the user. Many of the prior art apparatus require complicated levers to subject the exercised muscles to the resistive load. In addition, such devices frequently increase the resistance to the arm muscles at the stages of flexion or extension at which such muscles have their least reserve of strength. A simple yet safe and effective exercise apparatus is needed to intensely exercise the triceps, pectoral, and anterior and medial deltoid muscles.

SUMMARY OF THE INVENTION

The present invention provides an exercise apparatus which allows a user to intensely exercise the triceps, anterior and medial deltoid, and pectoral muscles without substantial risk of injury. The present invention utilizes free weights available in the typical gymnasium weight room which may be loaded in a safe manner without raising the free weight higher than the hips of the person loading the machine. The exercise apparatus may be loaded in a parked position such that the user may commence the exercise activity from a midpoint of the user's upper extremity range of motion.

The exercise apparatus is supported on a generally rectangular base on which a seat is mounted, the seat including a seat rest and a back rest against which a user seated on the seat rest may lean. Mounted to the frame opposing the seat is a central upright support post. A yoke member is hinged to the top of the upright support post by a dual pivot hinge. The yoke member includes an elongate transverse bar provided at each of its opposing ends with a primary lever which extends generally rearward toward the seat. The primary levers may diverge slightly as they extend rearward. Each primary lever has a handgrip mounted generally perpendicularly to the free end of the primary lever. Each handgrip is directed inwardly toward the other handgrip and each handgrip includes a first part mounted to the primary lever. A second part of the handgrip extends perpendicularly from the free end of the first part. The second part of each handgrip is oriented generally in parallel to and coplanar with the primary lever to which the handgrip is mounted. Perpendicularly mounted to the transverse bar and to each primary lever is a weight moment arm which extends rearward. Each weight moment arm has a free end to which is mounted a cylindrical weight receiving rod which extends outwardly from the weight moment arm at a substantial perpendicular. Olympic-style circular free weights may be suspended on the weight receiving rods as desired to provide sufficient loading for the exercise apparatus. The yoke is rotatively joined to the upright support post such that it may pivot around the axis of the upright support post. The rotation of the yoke about the vertical axis is severely restricted non-symmetrically to less than about ten degrees of rotation. The yoke is also pivotable about a horizontal axis disposed immediately above the vertical pivot connection of the yoke to the upright support post.

Extending upward from opposing sides of the frame are rest support members or standards having upper free ends on which each of the weight arms may rest. The upper free end of each rest support member is provided with an upstanding plate while each of the weight arms has a protrusion on its underside so that the upstanding plate of the rest support member may engage the protrusion of the weight arm to prevent horizontal rotation of the yoke when the weight arms are lowered to rest on the rest supports. The exercise apparatus is preferably stored in a parked position with the weight arms resting on the rest supports. Free weights may be added or removed from the opposing weight support rods while the exercise apparatus is in a parked position.

The user may raise or lower the seat upon its support post and then seat himself or herself upon the seat and grasp the handgrips at either the first or second regions thereof. The user may then press the yoke forward followed by slightly rotating the yoke about its vertical pivot axis on the upright support post to disconnect each primary arm from the rest support on which it has been resting. The rotation of the yoke may then be reversed after the weight moment arms are elevated sufficiently for the protrusion of the weight arms to clear the upstanding plates of the rest support members. Then the user may reciprocatingly operate the primary levers by pushing them away and then lowering them toward himself or herself.

It is an object of the invention to provide an effective exercise apparatus for the upper extremities which allows selective loading with free weights.

It is also an object of the invention to provide an exercise apparatus which allows intense yet safe exercise of the triceps, anterior and medial deltoid, and pectoral muscles.

It is a further object of the invention to provide an exercise apparatus which may be loaded with free weights without raising such weights above waist height.

It is yet another object of the invention to provide an exercise apparatus which may be adapted to users of various heights.

The foregoing and other salutary objects of the invention will be understood from review of the detailed description which follows.

DESCRIPTION OF THE DRAWING FIGURES

DETAILED DESCRIPTION OF THE INVENTION

Figure 1:
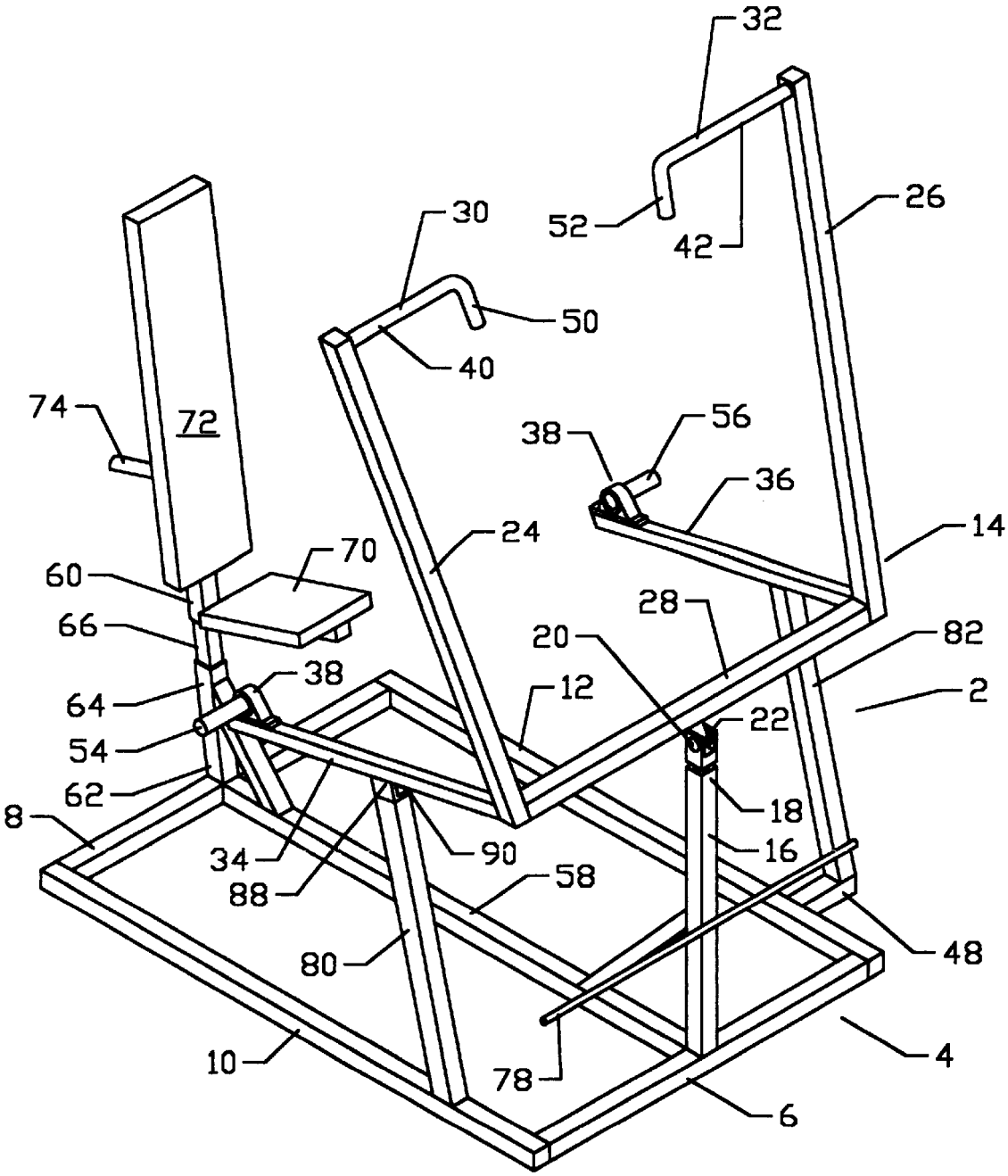
FIG. 1 is a front left perspective view of the exercise apparatus of the invention shown in its parked position with the weight arms resting atop standards on opposing sides of the frame.

Referring to the drawings, exercise machine 2 comprises a base frame 4 which rests on the floor. Mounted upstandingly on the first end 6 of base frame 4 is generally vertically oriented post 16 to which is pivotally mounted a yoke assembly 14. A foot rest 78 is centered on upright post 16. Yoke assembly 14 is hinged on post 16 such that it may be rotated about the axis of post 16 at the upper end 18 thereof, but only over a quite limited range, preferably approximately five to ten degrees. The horizontal rotational range of yoke assembly 14 is non-symmetrical such that yoke assembly 14 may rotate from a centered position on base frame 4 to a position where weight arms 34, 36 overlie standards 80, 82. Yoke assembly 14 is also hinged to post 16 such that it can pivot about a substantially horizontal axis defined by the axle 20 of dual hinge 22. Yoke assembly 14 includes a pair of operating levers 24, 26 which are spaced apart a greater distance than the shoulder width of the largest user who might be expected to use the exercise machine 2. Operating levers 24, 26 are mounted generally perpendicularly to a transverse bar 28 which is fixed at generally its midpoint to dual hinge 22. Operating levers 24, 26 are preferably mounted at the opposing ends of transverse bar 28 such that a user may fit easily between operating levers 24, 26. Operating levers 24, 26 diverge slightly as they extend rearward from their mounting to transverse bar 28.

Also depending rearwardly from each opposing end of transverse bar 28 are weight arms 34, 36 joined substantially perpendicularly to operating levers 24, 26 respectively. Weight arms 34, 36 are substantially parallel and each weight arm 34, 36 is fixed at a perpendicular to transverse bar 28. Depending inwardly from each of operating levers 24, 26 are handles 30, 32 each of which including a generally horizontal portion 40, 42 having a generally perpendicularly directed extension 50, 52 depending therefrom. Each of extensions 50, 52 is long enough to be comfortably and securely grasped by a hand of the user. Handles 30, 32 provide the user with a choice of methods to grip the handles, either with hands grasping extensions 50, 52 or with the hands held further apart grasping horizontal portions 40, 42. Extensions 50, 52 are generally parallel to the axes of operating levers 24, 26.

Weight arms 34, 36 are each provided adjacent the free ends 44, 46 thereof with weight support rods 54, 56, the weight support rods 54, 56 depending outwardly from weight arms 34, 36 and disposed substantially horizontally such that circular weight plates such as weight plate 9 may be mounted thereto. A supporting bracket 38 retains each of weight support rods 54, 56 to weight arms 34, 36 respectively.

Figure 3:
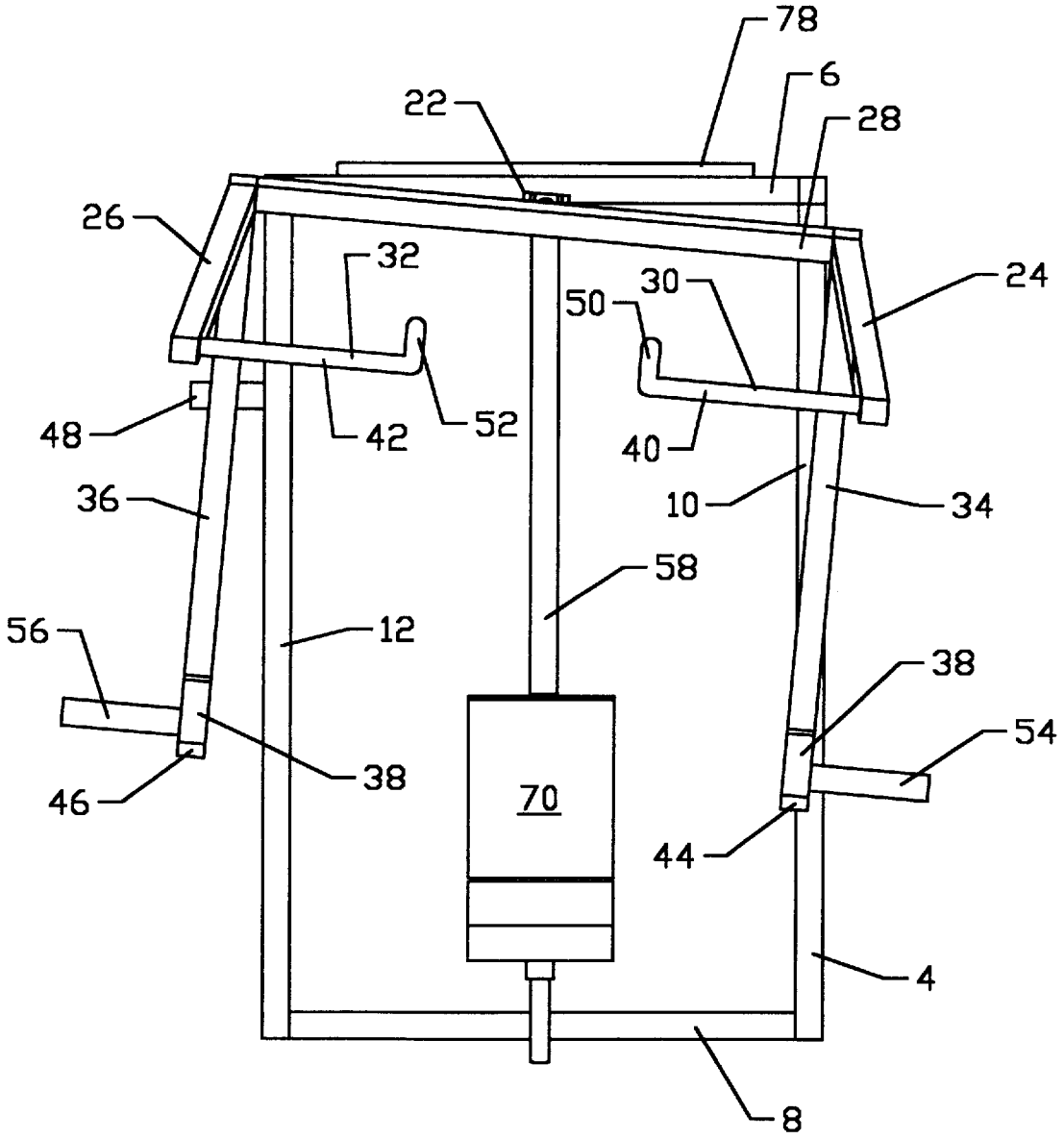
FIG. 3 is a top plan view of the exercise apparatus of FIG. 1.

Referring to the overhead view of FIG. 3, a longitudinal member 58 extends the length of base frame 4 and interconnects first end 6 with opposing second end 8. Longitudinal member 58 is disposed generally equidistant from each of opposing first and second sides 10, 12 of base frame 4.

Figure 4:
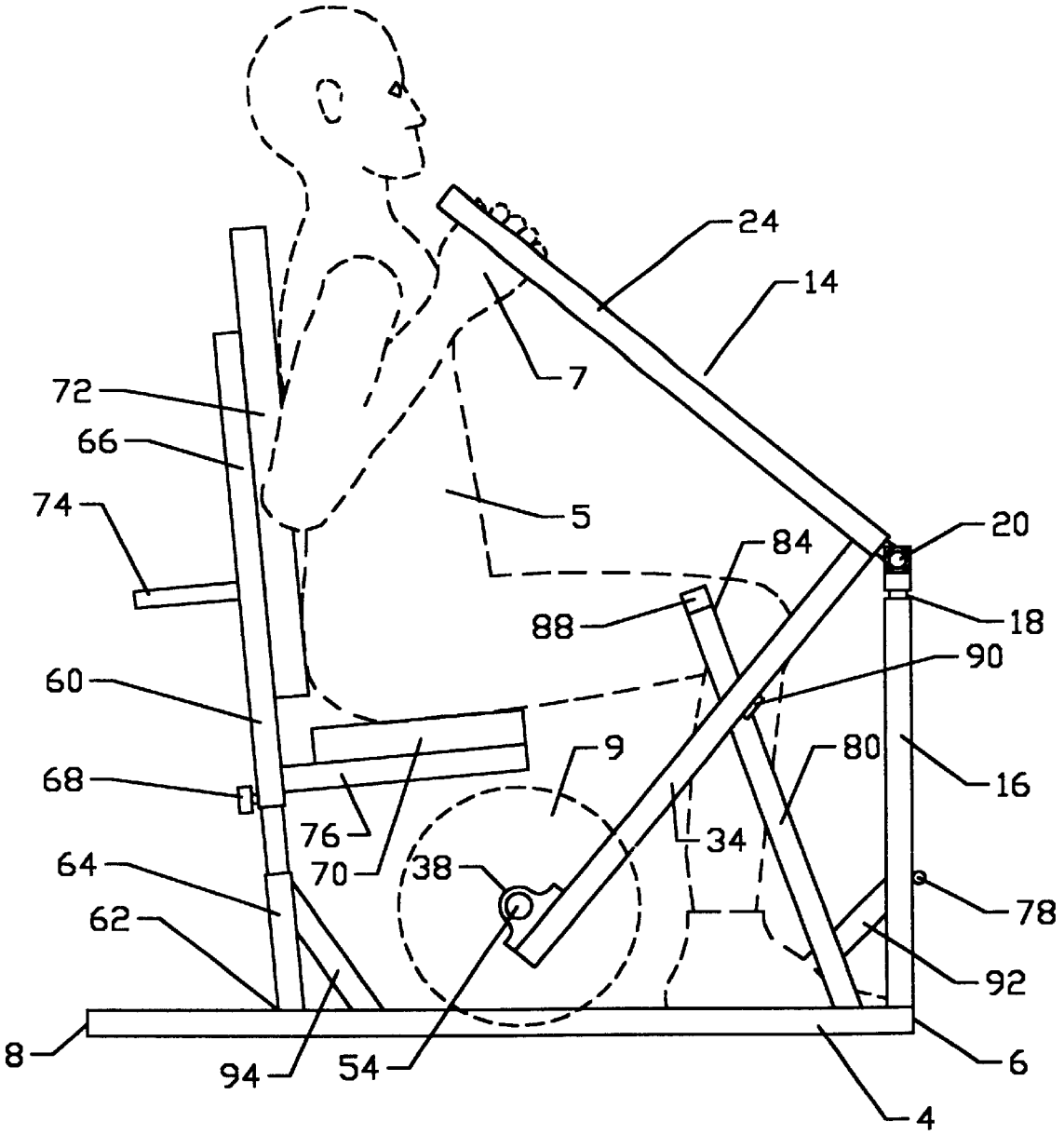
FIG. 4 is a side plan view showing the exercise apparatus in operation by a user shown by dashed lines.

As best seen in the side plan view of FIG. 4, a user 5 is seated on seat 70 leaning against back rest 72. User 5 has placed his hands 7 on the handles 30, 32 and has lowered the operating levers 24, 26 toward himself. Circular weight plates 9 may be mounted on weight support rods 54, 56. The lowering of operating levers 24, 26 allows weight support arms 34, 36 to rotate about axle 20.

A seat support bar 60 upstands from longitudinal member 58 spaced apart at its base 62 from second end 8 of base frame 4. Seat support bar 60 may comprise a lower box tube 64 on which is axially slidable upper box tube 66, with pin element 68 operable to lock upper box tube 66 at a fixed extension from lower box tube 64. Seat 70 is supported on seat frame 76 which is fixed generally perpendicularly to upper box tube 66. Back rest 72 is mounted to upper box tube 66. By selective adjustment of seat support bar 60, the height of seat 70 and back rest 72 can be properly set for the size of the user. Lift lever 74 depends outwardly from upper tube 66 for use to help lift upper box tube 66 when height adjustment of seat 70 and back rest 72 is desired. Seat support bar 60 inclines rearwardly to provide a slightly reclining position for a user seated on seat 70. A rear gusset support 94 stabilizes seat support bar 60 while front gusset support 92 strengthens upright post 16.

Figure 5:
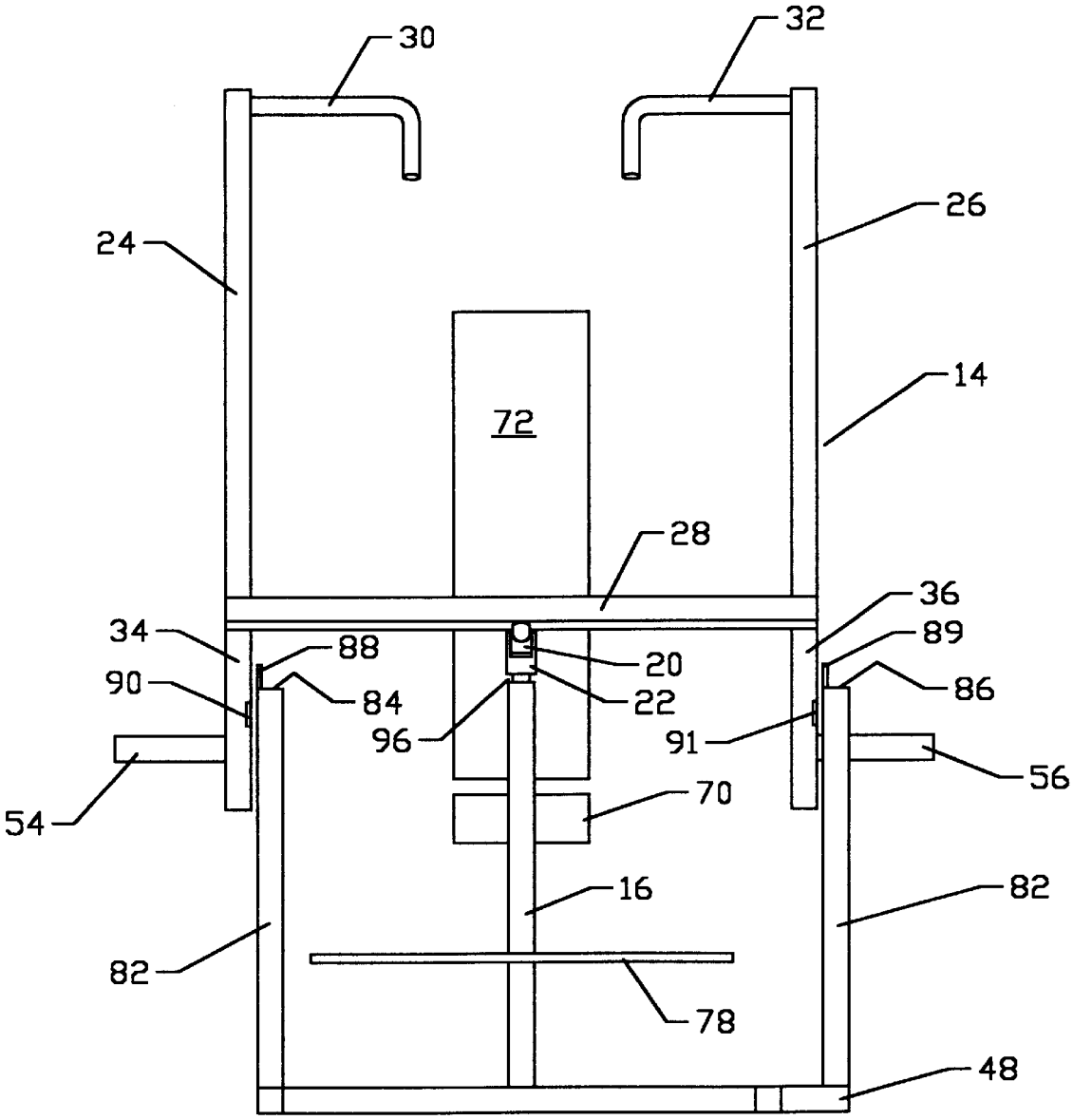
FIG. 5 is a front plan view of the exercise apparatus shown in an intermediate operating position.

Referring to FIG. 5, it is seen that upstanding from first side 10 of base frame 4 is standard 80 and upstanding from frame extension 48 which is mounted laterally to opposing side 12 is opposing standard 82. Standard 80 is coplanar with side 10 of base frame 4 to which it is mounted. Standard 82 upstands on frame extension 48 and parallels standard 80. Each of standards 80, 82 inclines rearwardly, preferably about ten to thirty degrees from vertical, such that the upper ends 84, 86 thereof may touchingly engage the weight arms 34, 36 respectively, along the lengths thereof, providing a rest for weight arms 34, 36 respectively. Preferably, each of standards 80, 82 will define a perpendicular in engagement with the weight arm 34, 36 it engages. Each of upper ends 84, 86 of standards 80, 82 is provided with a small upstanding plate 88 which touches the underside of each of weight arms 34, 36. Each of weight arms 34, 36 is provided with a protruding ridge 90 on its underside. As is seen in FIG. 5, each upstanding plate 88, 89 is mounted at the left edge of upper end 84, 86 of standards 80, 82 respectively. Conversely, each ridge 90, 91 depending from the underside of weight arms 34, 36 respectively is mounted at the right edge of the underside of weight arm 34, 36.

When yoke assembly 14 is urged upward sufficiently that weight arms 34, 36 are disposed higher than the reach of upstanding plates 88, 89 of upper ends 84, 86 of standards 80, 82 respectively, yoke assembly 14 may be rotated about the vertical axis of dual hinge 22 to position weight arms 34, 36 in alignment vertically with standards 80, 82 respectively. Operating levers 24, 26 may then be lowered to permit weight arms 34, 36 to rest atop upstanding plates 88, 89 of standards 80, 82 respectively. When weight arms 34, 36 are so aligned with standards 80, 82, upstanding plates 88, 89 are disposed laterally to protruding ridges 90, 91 of weight arms 34, 36. If lateral movement of the yoke assembly 14 should be attempted, the abutment of protruding ridges 90, 91 on upstanding plates 88, 89 will prevent weight arms 34, 36 from being displaced from their rests upon standards 80, 82 respectively. A stop 96 limits lateral rotation of dual hinge 22 to prevent rotation of yoke assembly 14 in the opposite direction.

OPERATION OF THE INVENTION

Figure 2:
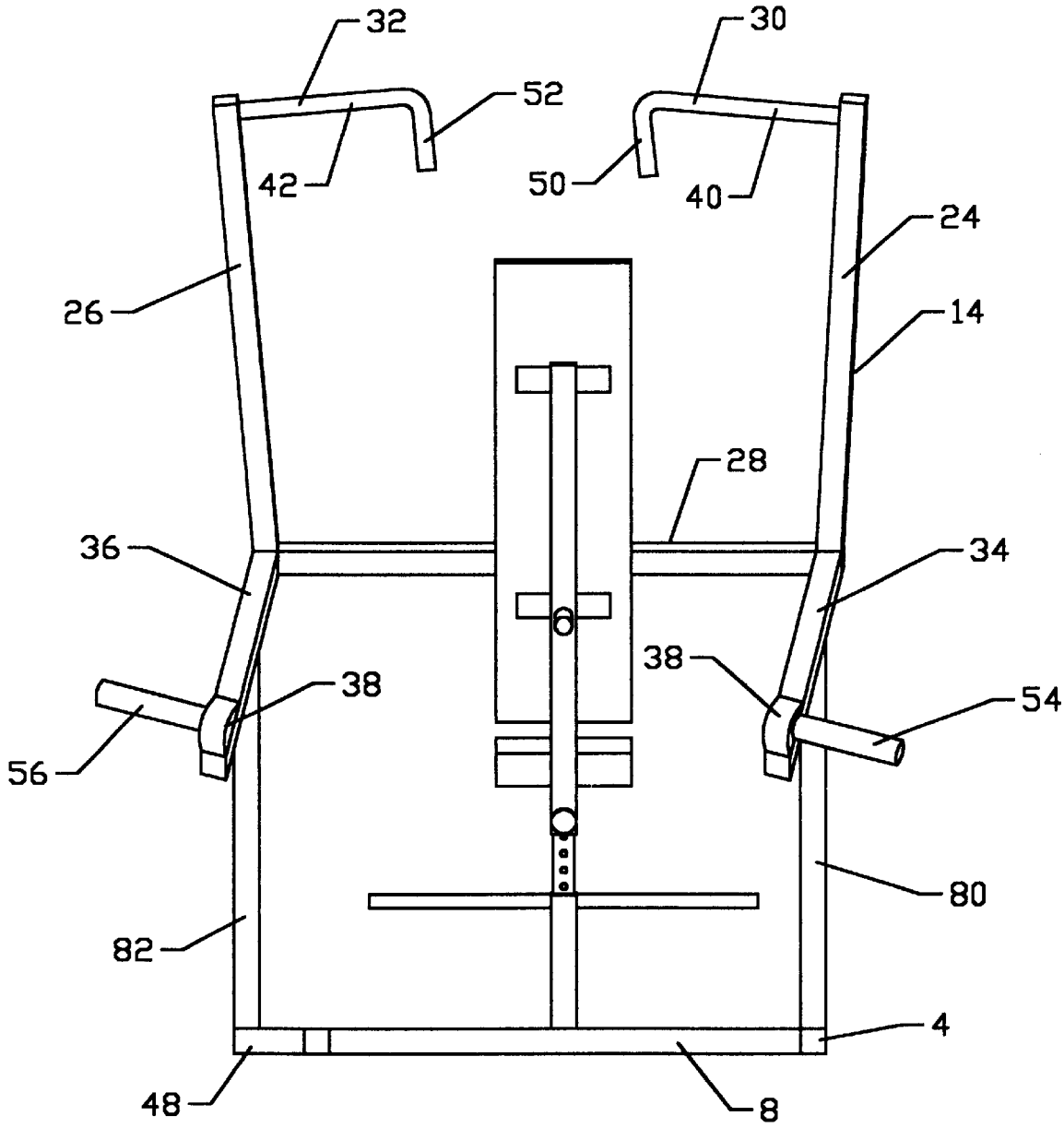
FIG. 2 is a rear plan view of the exercise apparatus of FIG. 1 shown in its parked position.

After each use the exercise apparatus 2 is preferably left in its parked position as shown in FIGS. 1–3. When use is to be begun, the user may first adjust the height of seat 70 and back rest 72 by pulling spring loaded pin 68 rearward from its seat in upper box tube 66. The upper box tube 66 may then be raised or lowered by use of seat handle 74 to slide upper box tube 66 longitudinally in lower box tube 64, and pin 68 will lock upper box tube 66 to lower box tube 64 corresponding to the selected height of seat 70. Appropriate weights 9 may be placed on weight support rods 54, 56 as desired.

The user may then be seated on seat 70 and recline against back rest 72. Grasping handles 30, 32, the user may then urge operating levers 24, 26 away from himself, thereby lifting weight arms 34, 36 above the upstanding plates 88, 89 of standards 80, 82. The user may then rotate yoke assembly 14 to the user's right sufficiently that weight arms 34, 36 may freely move vertically without touching standards 80, 82. Repetitive exercise of the triceps, medial and anterior deltoids and pectorals can then be accomplished by first pushing operating levers 24, 26 away and then resisting return of the operating levers 24, 26. Because weights 9 rotate about pivot axle 20, the moment of the weights 9 is reduced while the handles 30, 32 are close to the user, and the moment increases as the arms of the user extend and the strength of the user's arms increases. This normal operation permits efficient and effective exercise of the triceps, deltoid and pectoral muscles of the user.

Many variations will be apparent to those skilled in the art. It is therefore to be understood, that within the scope of the appended claims, the invention may be practiced other than as specifically described.

Having described the invention, I claim:

1. Exercise apparatus for the upper extremities comprising a base frame having a generally upright post mounted thereon, a yoke pivotally supported upon said upright post, said yoke pivotal over a limited range about a substantially vertical axis retained to said post, said yoke further pivotal about a horizontal axis retained to said upstanding post, said yoke comprising a transverse bar having opposing ends, a pair of spaced apart lever members, and a pair of spaced apart weight arms, each of said pair of lever members fixed to said transverse bar and coplanar therewith, each of said pair of lever members extending substantially perpendicularly from said transverse bar, each of said pair of weight arms fixed to said transverse bar and coplanar therewith, each of said pair of weight arms extending in parallel substantially perpendicularly from said transverse bar, a first of said pair of lever members diverging from a first of said pair of weight arms at a fixed angle, the other of said pair of lever members diverging from the other of said pair of weight arms at said fixed angle between said first of said lever members and said first of said weight arms, each of said weight arms having a free end thereon, said weight arms including means adjacent said free ends thereof for suspending free weights on said weight arms, each of said lever members having an inwardly directed handle thereon for grasping by a user's hands.

2. The exercise apparatus of claim 1 wherein a pair of standards upstand from said base frame, a first of said pair of standards corresponding to a first of said weight arms, the other of said pair of standards corresponding to the other of said weight arms, said yoke may be positioned in an operating position whereby said weight arms do not overlie said standards, said yoke may be positioned in a park position whereby said weight arms rest upon said standards.

3. The exercise apparatus of claim 1 wherein said pair of lever members mutually diverge as they extend from said transverse bar.

4. The exercise apparatus of claim 1 wherein a seat member is mounted to said frame spaced apart from said upright post, said seat member supported by an inclined support bar mounted to said base frame, said inclined support bar inclined away from said upright post, said inclined support bar selectively variable in height whereby said seat member may be raised or lowered.

5. The exercise apparatus of claim 4 wherein said seat member including a generally horizontally disposed seat and an inclining seat back, said seat member generally equidistant from each of said weight arms when said exercise apparatus is in an operating mode.

6. The exercise apparatus of claim 1 wherein said means for suspending free weights on said weight arms comprises a horizontally disposed bar extending from each of said weight arms.

7. The exercise apparatus of claim 1 wherein said transverse bar is centered upon said pivot mounting of said yoke upon said upright post, each of said lever arms is mounted to an opposing end of said transverse bar, each of said weight arms is mounted to an opposing end of said transverse bar, each of said lever arms is of equal length, each of said weight arms is of equal length, said first of said pair of lever members mounted to said transverse bar at generally a perpendicular to said first of said pair of weight arms, said other of said pair of lever members mounted to said transverse bar at generally a perpendicular to said other of said pair of weight arms.

8. The exercise apparatus of claim 7 wherein said base frame is of generally rectangular shape having a front end, a rear end opposing the front end, and opposing sides interconnecting said front end and said rear end, said upright post generally centered upon said front end.

9. The exercise apparatus of claim 8 wherein a pair of standards upstand from said base frame, a first of said pair of standards corresponding to a first of said weight arms, the other of said pair of standards corresponding to the other of said weight arms, said yoke may be positioned in an operating position whereby said weight arms do not overlie said standards, said yoke may be positioned in a park position whereby said weight arms rest upon said standards.

10. The exercise apparatus of claim 9 wherein said pair of lever members mutually diverge as they extend from said transverse bar.

11. The exercise apparatus of claim 10 wherein a seat member is mounted to said frame spaced apart from said upright post, said seat member supported by an inclined support bar mounted to said base frame, said inclined support bar inclined away from said upright post, said inclined support bar selectively variable in height whereby said seat member may be raised or lowered.

12. The exercise apparatus of claim 11 wherein said seat member including a generally horizontally disposed seat and an inclining seat back, said seat member generally equidistant from each of said weight arms when said exercise apparatus is in an operating mode.

13. The exercise apparatus of claim 12 wherein said means for suspending free weights on said weight arms comprises a horizontally disposed bar extending outwardly from each of said weight arms.

14. The exercise apparatus of claim 13 wherein each of said standards inclined toward said rear end of said frame.

15. The exercise apparatus of claim 14 wherein each of said standards having an upright plate extending upwardly therefrom, each of said weight arms having a ridge depending therebelow, said upright plate of each of said standards selectively engageable with the ridge of each of said weight arms.

16. An exercise apparatus for strengthening triceps, anterior and medial deltoid, and pectoral muscle groups comprising a base having opposing ends, a support member fixed to said base to support a moveable assembly at a position above said base, the movable assembly comprising a pair of spaced apart levers mounted to a transverse bar and a pair of spaced apart weight arms mounted to said transverse bar, said transverse bar pivotably retained at generally the midpoint thereof to said support member and pivotal about a vertical axis retained to said support member, said transverse bar further pivotal about a horizontal axis retained to said support member, said spaced apart levers mounted generally perpendicularly to said transverse bar, said weight arms mounted substantially perpendicularly to said transverse bar, each of said weight arms having a free end with a bar to receive free weights thereon, said levers having free ends opposing said mounting to said transverse bar, said free ends of said levers having inwardly disposed handles whereby a user may grasp said handles and move said levers away from the user while raising said weights on said weight arms through an arcuate path.

17. The exercise apparatus of claim 16 wherein a seat member is mounted to said base spaced apart from said support member, said seat member comprising a generally horizontally disposed seat and an adjacent reclining back rest, whereby a user may seat himself or herself on said seat and lean against said back rest while grasping said handles.

18. The exercise apparatus of claim 16 wherein said base having inclined upright rest support members mounted thereto, said rest support members having free upper ends, said rest support members corresponding to said weight arms and each of said rest members disposed to receive one of said weight arms on the free end thereof, said weight arms resting on said rest support members when said exercise apparatus is an a parked position, said weight arms disposed in nonalignment vertically to said rest support members when said exercise apparatus in an operating position.

19. The exercise apparatus of claim 18 wherein each of said rest support members is provided with an upstanding plate on said free end thereof, each of said weight arms is provided with a protruding ridge depending therebelow, said protruding ridges of each of said weight arms disposed to laterally touch or oppose said upstanding plate of said corresponding rest support member when said weight arms are resting upon said rest support members, said ridges of said weight arms acting as lateral movement stop members to touchingly engage said upstanding plates when said moveable assembly is in its parked position.

20. The exercise apparatus of claim 18 wherein a stop member is provided on said support member to limit horizontal rotation of said transverse bar on said support member to a range of about five to ten degrees of rotation, said range of rotation of said transverse bar being nonsymmetrical, whereby said transverse bar may not rotate to positions wherein said weight arms may vertically move alongside said rest support members on either side thereof.

* * * * *

UNITED STATES PATENT AND TRADEMARK OFFICE

CERTIFICATE OF CORRECTION

PATENT NO. : 6,358,189 B1
DATED : March 19, 2002
INVENTOR(S) : Larry D. Koenig

It is certified that error appears in the above-identified patent and that said Letters Patent is hereby corrected as shown below:

Column 5,
Line 26, delete "upstanding" and substitute therefor -- upright --.

Signed and Sealed this

Eighteenth Day of June, 2002

*Attest:*

*Attesting Officer*

JAMES E. ROGAN
*Director of the United States Patent and Trademark Office*